US009486013B2

(12) United States Patent
Sebastian et al.

(10) Patent No.: US 9,486,013 B2
(45) Date of Patent: Nov. 8, 2016

(54) SEGMENTED SMOKING ARTICLE WITH FOAMED INSULATION MATERIAL

(71) Applicants: Andries Don Sebastian, Clemmons, NC (US); Billy Tyrone Conner, Clemmons, NC (US); Chandra K. Banerjee, Clemmons, NC (US); Steven L. Alderman, Lewisville, NC (US); Paul E. Braxton, Summerfield, NC (US); Carolyn R. Carpenter, Lewisville, NC (US); Alvaro Gonzalez-Parra, Clemmons, NC (US); Bradley J. Ingebrethsen, Long Beach, NJ (US); Kristen L. Murray, Advance, NC (US); Timothy B. Nestor, Advance, NC (US); Evon Llewellyn Crooks, Mocksville, NC (US)

(72) Inventors: Andries Don Sebastian, Clemmons, NC (US); Billy Tyrone Conner, Clemmons, NC (US); Chandra K. Banerjee, Clemmons, NC (US); Steven L. Alderman, Lewisville, NC (US); Paul E. Braxton, Summerfield, NC (US); Carolyn R. Carpenter, Lewisville, NC (US); Alvaro Gonzalez-Parra, Clemmons, NC (US); Bradley J. Ingebrethsen, Long Beach, NJ (US); Kristen L. Murray, Advance, NC (US); Timothy B. Nestor, Advance, NC (US); Evon Llewellyn Crooks, Mocksville, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 609 days.

(21) Appl. No.: 13/870,684

(22) Filed: Apr. 25, 2013

(65) Prior Publication Data

US 2013/0233329 A1 Sep. 12, 2013

Related U.S. Application Data

(62) Division of application No. 12/546,107, filed on Aug. 24, 2009, now Pat. No. 8,464,726.

(51) Int. Cl.
*A24F 47/00* (2006.01)

(52) U.S. Cl.
CPC ..... *A24F 47/004* (2013.01); *A24F 47/006* (2013.01)

(58) Field of Classification Search
None
See application file for complete search history.

(56) References Cited

U.S. PATENT DOCUMENTS 2,976,190 A 3/1961 Meyer
3,308,600 A 3/1967 Erdmann et al.
(Continued)

FOREIGN PATENT DOCUMENTS

EP 0 399 252 A2 11/1990
EP 0 532 194 A1 3/1993
(Continued)

OTHER PUBLICATIONS

US 5,119,837, 06/1992, Banerjee et al. (withdrawn)
(Continued)

*Primary Examiner* — Michael J Felton
(74) *Attorney, Agent, or Firm* — Brinks Gilson & Lione

(57) ABSTRACT

A cigarette includes lighting and mouth ends. It may include a smokable segment disposed at the lighting end. It also includes a mouth-end segment; an aerosol-generation system disposed between the lighting and mouth ends, which includes (i) a heat-generation segment adjacent the smokable segment, including a heat source configured to be activated by combustion of a smokable material and an insulation layer of a non-glass material that is woven, knit, or both, and (ii) an aerosol-generating segment with aerosol-forming material disposed between, but physically separate from, each of the heat generation segment and the mouth end; a piece of outer wrapping material that provides an overwrap around at least a portion of the aerosol-generating segment, the heat-generation segment, and at least a portion of the smokable segment; those segments being connected together by the overwrap to provide a cigarette rod; that is connected to the cigarette rod using tipping material.

25 Claims, 1 Drawing Sheet

(56) References Cited

U.S. PATENT DOCUMENTS

| | | | |
|---|---|---|---|
| 3,586,005 | A | 6/1971 | Lippman, Jr. et al. |
| 3,709,706 | A | 1/1973 | Sowman |
| 3,840,024 | A | 10/1974 | Nicholl |
| 4,280,187 | A | 7/1981 | Reuland et al. |
| 4,281,670 | A | 8/1981 | Heitmann et al. |
| 4,572,216 | A | 2/1986 | Josuttis et al. |
| 4,714,082 | A | 12/1987 | Banerjee et al. |
| 4,756,318 | A | 7/1988 | Clearman et al. |
| 4,807,809 | A | 2/1989 | Pryor et al. |
| 4,850,301 | A | 7/1989 | Greene, Jr. et al. |
| 4,881,556 | A | 11/1989 | Clearman et al. |
| 4,893,637 | A | 1/1990 | Hancock et al. |
| 4,922,901 | A | 5/1990 | Brooks et al. |
| 4,938,238 | A | 7/1990 | Barnes et al. |
| 4,989,619 | A | 2/1991 | Clearman et al. |
| 5,020,548 | A | 6/1991 | Farrier et al. |
| 5,025,814 | A | 6/1991 | Raker |
| 5,027,836 | A | 7/1991 | Shannon et al. |
| 5,027,837 | A | 7/1991 | Clearman et al. |
| 5,040,551 | A | 8/1991 | Schlatter et al. |
| 5,042,509 | A | 8/1991 | Banerjee et al. |
| 5,065,776 | A | 11/1991 | Lawson et al. |
| 5,067,499 | A | 11/1991 | Banerjee et al. |
| 5,076,297 | A | 12/1991 | Farrier et al. |
| 5,099,861 | A | 3/1992 | Clearman et al. |
| 5,105,831 | A | 4/1992 | Banerjee et al. |
| 5,105,837 | A | 4/1992 | Barnes et al. |
| 5,105,838 | A | 4/1992 | White et al. |
| 5,115,820 | A | 5/1992 | Hauser et al. |
| 5,129,409 | A | 7/1992 | White et al. |
| 5,137,034 | A | 8/1992 | Perfetti et al. |
| 5,148,821 | A | 9/1992 | Best et al. |
| 5,156,170 | A | 10/1992 | Clearman et al. |
| 5,178,167 | A | 1/1993 | Riggs et al. |
| 5,183,062 | A | 2/1993 | Clearman et al. |
| 5,203,355 | A | 4/1993 | Clearman et al. |
| 5,211,684 | A | 5/1993 | Shannon et al. |
| 5,246,017 | A | 9/1993 | Saintsing et al. |
| 5,247,947 | A | 9/1993 | Clearman et al. |
| 5,285,798 | A | 2/1994 | Banerjee et al. |
| 5,303,720 | A | 4/1994 | Banerjee et al. |
| 5,345,955 | A | 9/1994 | Clearman et al. |
| 5,396,911 | A | 3/1995 | Casey, III et al. |
| 5,415,186 | A | 5/1995 | Casey, III et al. |
| 5,469,871 | A | 11/1995 | Barnes et al. |
| 5,546,965 | A | 8/1996 | White |
| 5,551,451 | A | 9/1996 | Riggs et al. |
| 5,560,376 | A | 10/1996 | Meiring et al. |
| 5,588,446 | A | 12/1996 | Clearman |
| 5,622,190 | A | 4/1997 | Arterbery et al. |
| 5,706,834 | A | 1/1998 | Meiring et al. |
| 5,720,320 | A | 2/1998 | Evans |
| 5,724,997 | A | 3/1998 | Smith et al. |
| 5,727,571 | A | 3/1998 | Meiring et al. |
| 5,791,384 | A | 8/1998 | Evans |
| 5,819,751 | A | 10/1998 | Barnes et al. |
| 5,902,431 | A | 5/1999 | Wilkinson et al. |
| 5,944,025 | A | 8/1999 | Cook et al. |
| 6,229,115 | B1 | 5/2001 | Voss et al. |
| 6,849,085 | B2 | 2/2005 | Marton |
| 7,290,549 | B2 | 11/2007 | Banerjee et al. |
| 7,293,593 | B2 | 11/2007 | Schiebout |
| 7,296,578 | B2 | 11/2007 | Read, Jr. |
| 7,434,585 | B2 | 10/2008 | Holmes |
| 7,479,098 | B2 | 1/2009 | Thomas et al. |
| 7,503,330 | B2 | 3/2009 | Borschke et al. |
| 7,647,932 | B2 | 1/2010 | Cantrell et al. |
| 7,740,019 | B2 | 6/2010 | Nelson et al. |
| 7,793,665 | B2 | 9/2010 | Dube et al. |
| 7,836,897 | B2 | 11/2010 | Borschke et al. |
| 7,972,254 | B2 | 7/2011 | Stokes et al. |
| 2002/0119873 | A1 | 8/2002 | Heitmann |
| 2004/0031495 | A1 | 2/2004 | Steinberg |
| 2004/0173229 | A1 | 9/2004 | Crooks et al. |
| 2005/0066986 | A1 | 3/2005 | Nestor et al. |
| 2005/0274390 | A1 | 12/2005 | Banerjee et al. |
| 2006/0112963 | A1 | 6/2006 | Scott et al. |
| 2006/0169295 | A1 | 8/2006 | Draghetti |
| 2006/0201524 | A1 | 9/2006 | Zhang et al. |
| 2006/0231113 | A1 | 10/2006 | Newbery et al. |
| 2006/0272663 | A1 | 12/2006 | Dube et al. |
| 2007/0023056 | A1 | 2/2007 | Cantrell et al. |
| 2007/0181141 | A1 | 8/2007 | Xue et al. |
| 2007/0186945 | A1 | 8/2007 | Olegario et al. |
| 2007/0215167 | A1 | 9/2007 | Llewellyn Crooks et al. |
| 2007/0215168 | A1 | 9/2007 | Banerjee et al. |
| 2008/0029118 | A1 | 2/2008 | Nelson et al. |
| 2008/0092912 | A1 | 4/2008 | Robinson et al. |
| 2008/0142028 | A1 | 6/2008 | Fagg |
| 2008/0233294 | A1 | 9/2008 | Lobovsky et al. |
| 2009/0044818 | A1 | 2/2009 | Takeuchi et al. |
| 2009/0090372 | A1 | 4/2009 | Thomas et al. |
| 2009/0090373 | A1 | 4/2009 | Borschke et al. |
| 2009/0194118 | A1 | 8/2009 | Ademe et al. |
| 2009/0288667 | A1 | 11/2009 | Andresen et al. |
| 2009/0288672 | A1 | 11/2009 | Hutchens |
| 2010/0065075 | A1 | 3/2010 | Banerjee et al. |
| 2010/0186757 | A1 | 7/2010 | Crooks et al. |
| 2010/0200006 | A1 | 8/2010 | Robinson et al. |
| 2011/0041861 | A1 | 2/2011 | Sebastian et al. |
| 2011/0180082 | A1 | 7/2011 | Banerjee et al. |

FOREIGN PATENT DOCUMENTS

| | | | |
|---|---|---|---|
| EP | 1 226 765 | A2 | 7/2002 |
| EP | 1 559 332 | A1 | 8/2005 |
| WO | WO 2008/015441 | A1 | 2/2008 |
| WO | WO 2009/112257 | A1 | 9/2009 |
| WO | WO 2009/132828 | A1 | 11/2009 |
| WO | WO 2011/028372 | A1 | 3/2011 |
| WO | WO 2011/139730 | A1 | 11/2011 |

OTHER PUBLICATIONS

International Search Report for International Application No. PCT/US2010/044989, dated Jan. 21, 2011, 2 pages.

Written Opinion of the International Searching Authority for International Application No. PCT/US2010/044989, dated Jan. 21, 2011, 6 pages.

International Search Report for International Application No. PCT/US2011/034040, dated Oct. 19, 2011, 3 pages.

U.S. Appl. No. 11/377,630.

U.S. Appl. No. 12/688,598.

U.S. Appl. No. 12/775,130.

U.S. Appl. No. 12/775,278.

U.S. Appl. No. 12/859,494.

U.S. Appl. No. 13/236,962.

SEGMENTED SMOKING ARTICLE WITH FOAMED INSULATION MATERIAL

CROSS-REFERENCE TO RELATED APPLICATIONS

This application is a divisional application of and claims priority to U.S. patent application Ser. No. 12/546,107, filed Aug. 24, 2009, which is incorporated by reference herein in its entirety.

TECHNICAL FIELD

The present application relates generally to tobacco products, such as smoking articles (e.g., cigarettes), and particularly to components and configurations of segmented-type smoking articles.

BACKGROUND

Popular smoking articles, such as cigarettes, have a substantially cylindrical rod-shaped structure and include a charge, roll or column of smokable material, such as shredded tobacco (e.g., in cut filler form), surrounded by a paper wrapper, thereby forming a so-called "smokable rod", "tobacco rod" or "cigarette rod." Normally, a cigarette has a cylindrical filter element aligned in an end-to-end relationship with the tobacco rod. Preferably, a filter element comprises plasticized cellulose acetate tow circumscribed by a paper material known as "plug wrap." Preferably, the filter element is attached to one end of the tobacco rod using a circumscribing wrapping material known as "tipping paper." It also has become desirable to perforate the tipping material and plug wrap, in order to provide dilution of drawn mainstream smoke with ambient air. Descriptions of cigarettes and the various components thereof are set forth in Tobacco Production, Chemistry and Technology, Davis et al. (Eds.) (1999) and U.S. Pat. No. 7,503,330 to Borschke et al, which is incorporated herein by reference. A cigarette is employed by a smoker by lighting one end thereof and burning the tobacco rod. The smoker then receives mainstream smoke into his/her mouth by drawing on the opposite end (e.g., the filter end) of the cigarette.

Certain types of cigarettes that employ carbonaceous fuel elements have been commercially marketed under the brand names "Premier" and "Eclipse" by R. J. Reynolds Tobacco Company. See, for example, those types of cigarettes described in Chemical and Biological Studies on New Cigarette Prototypes that Heat Instead of Burn Tobacco, R. J. Reynolds Tobacco Company Monograph (1988) and Inhalation Toxicology, 12:5, p. 1-58 (2000). More recently, a cigarette has been marketed in Japan by Japan Tobacco Inc. under the brand name "Steam Hot One.: It has also been suggested that the carbonaceous fuel elements of segmented types of cigarettes may incorporate ultrafine particles of metals and metal oxides. See, for example, U.S. Pat. App. Pub. No. 2005/0274390 to Banerjee et al., which is incorporated by reference herein in its entirety.

Yet other types of smoking articles, such as those types of smoking articles that generate flavored vapors by subjecting tobacco or processed tobaccos to heat produced from chemical or electrical heat sources are described in U.S. Pat. No. 5,285,798 to Banerjee et al. and U.S. Pat. No. 7,290,549 to Banerjee et al., and U.S. Pat. App. Pub. No. 2008/0092912 to Robinson et al., which are incorporated by reference herein in their entirety. One type of smoking article that has employed electrical energy to produce heat has been commercially marketed by Philip Morris Inc. under the brand name "Accord."

Smoking articles that employ sources of heat other than tobacco cut filler to produce tobacco-flavored vapors or tobacco-flavored visible aerosols have not received widespread commercial success. However, it would be highly desirable to provide smoking articles that demonstrate the ability to provide to a smoker many of the benefits and advantages of conventional cigarette smoking, without delivering considerable quantities of incomplete combustion and pyrolysis products.

SUMMARY

Embodiments of the present invention relate to smoking articles, and in particular, to rod-shaped smoking articles, such as cigarettes. A smoking article includes a lighting end (i.e., an upstream end) and a mouth end (i.e., a downstream end). The smoking article also includes an aerosol-generation system that includes (i) a heat generation segment, and (ii) an aerosol-generating region or segment located downstream from the heat generation segment. The smoking article may be configured in a variety of ways, including various insulative configurations related to the heat generation segment that may include one or more of glass or non-glass fiber materials that may or may not be woven, foamed monolithic material selected from metal, ceramic, and ceramic-metal composite (e.g., cermet), or other materials, which materials may also be incorporated in a buffer region between the heat generation and aerosol-generation segments.

Further features and advantages of the present invention are set forth in more detail in the following description.

DETAILED DESCRIPTION OF THE PREFERRED EMBODIMENTS

Aspects and embodiments of the present invention relating to various smoking articles, the arrangement of various components thereof, and the manner that those smoking articles incorporate overwrap components, are illustrated with reference to FIGS. 1 and 2. Like components are given like numeric designations throughout the figures. For the various figures, the thicknesses of the various wrapping materials and overwraps of the various smoking articles and smoking article components are exaggerated. Most preferably, wrapping materials and overwrap components are tightly wrapped around the smoking articles and smoking article components to provide a tight fit, and provide an aesthetically pleasing appearance.

Figure 1:
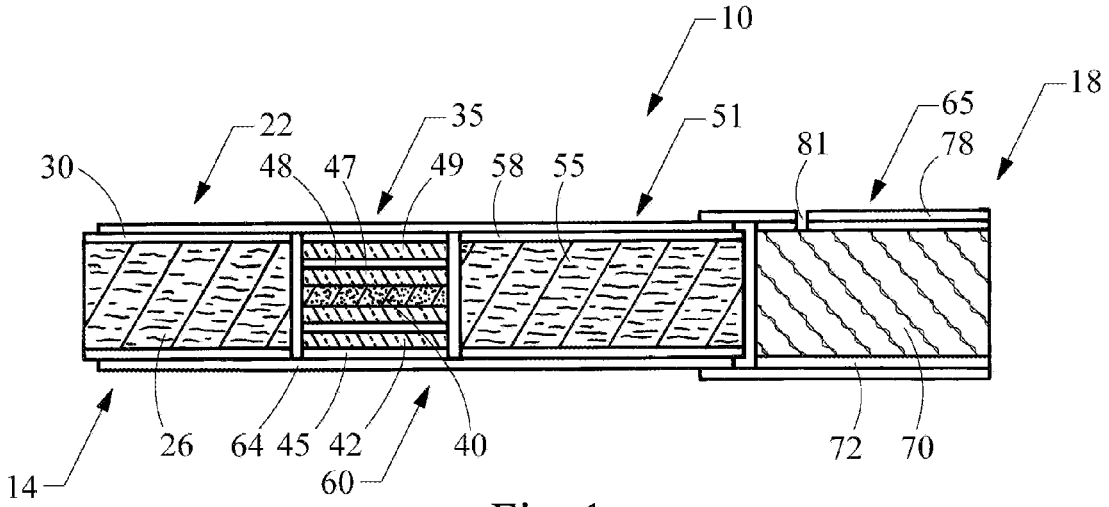
FIG. 1 and FIG. 2 provide longitudinal cross-sectional views of representative smoking articles.

Referring to FIG. 1, a representative smoking article 10 in the form of a cigarette is shown. The smoking article 10 has a rod-like shape, and includes a lighting end 14 and a mouth end 18.

At the lighting end 14 is positioned a longitudinally extending, generally cylindrical smokable lighting end segment 22, incorporating smokable material 26. A representative smokable material 26 can be a plant-derived material (e.g., tobacco material in cut filler form). An exemplary cylindrical smokable lighting end segment 22 includes a charge or roll of the smokable material 26 (e.g., tobacco cut filler) wrapped or disposed within, and circumscribed by, a paper wrapping material 30. As such, the longitudinally extending outer surface of that cylindrical smokable lighting end segment 22 is provided by the wrapping material 30. Preferably, both ends of the segment 22 are open to expose the smokable material 26. The smokable lighting end segment 22 can be configured so that smokable material 26 and wrapping material 30 each extend along the entire length thereof.

Located downstream from the smokable lighting end segment 22 is a longitudinally extending, generally cylindrical heat generation segment 35. The heat generation segment 35 includes a heat source 40 circumscribed by insulation 42, which may be coaxially encircled by wrapping material 45. The heat source 40 preferably is configured to be activated by combustion of the smokable material 26. Ignition and combustion of the smoking material preferably provide a user with a desirable experience (with respect at least to flavor and time taken to light the smoking article 10). The heat generated as the smokable material is consumed most preferably is sufficient to ignite or otherwise activate the heat source 40.

The heat source 40 may include a combustible fuel element that has a generally cylindrical shape and can incorporate a combustible carbonaceous material. Carbonaceous materials generally have high carbon contents. Preferred carbonaceous materials are composed predominately of carbon, typically have carbon contents of greater than about 60 percent, generally greater than about 70 percent, often greater than about 80 percent, and frequently greater than about 90 percent, on a dry weight basis. Fuel elements can incorporate components other than combustible carbonaceous materials (e.g., tobacco components, such as powdered tobaccos or tobacco extracts; flavoring agents; salts, such as sodium chloride, potassium chloride and sodium carbonate; heat stable graphite fibers; iron oxide powder; glass filaments; powdered calcium carbonate; alumina granules; ammonia sources, such as ammonia salts; and/or binding agents, such as guar gum, ammonium alginate and sodium alginate). A representative fuel element has a length of about 12 mm and an overall outside diameter of about 4.2 mm. A representative fuel element can be extruded or compounded using a ground or powdered carbonaceous material, and has a density that is greater than about 0.5 $g/cm^3$, often greater than about 0.7 $g/cm^3$, and frequently greater than about 1 $g/cm^3$, on a dry weight basis. See, for example, the types of fuel element components, formulations and designs set forth in U.S. Pat. No. 5,551,451 to Riggs et al. and U.S. Pat. App. Pub. No. 2009/0090373 to Borschke et al., which are incorporated herein by reference in their entirety.

Another embodiment of a fuel element 40 may include a foamed carbon monolith formed in a foam process of the type disclosed in U.S. Pat. App. Pub. No. 2008/0233294 to Lobovsky, which is incorporated herein by reference. This embodiment may provide advantages with regard to reduced time taken to ignite the heat source. In another embodiment, the fuel element 40 may be co-extruded with a layer of insulation 42, thereby reducing manufacturing time and expense. Still other embodiments of fuel elements may include carbon fibers of the type described in U.S. Pat. No. 4,922,901 to Brooks et al. or other heat source embodiments such as is disclosed in U.S. Pat. App. Pub. No. 2009/0044818 to Takeuchi et al., each of which is incorporated herein by reference.

A representative layer of insulation 42 can comprise glass filaments or fibers. The insulation 42 can act as a jacket that assists in maintaining the heat source 40 firmly in place within the smoking article 10. The insulation 42 can be provided as a multi-layer component including an inner layer or mat 47 of non-woven glass filaments, an intermediate layer of reconstituted tobacco paper 48, and an outer layer of non-woven glass filaments 49. These may be concentrically oriented or each overwrapping and/or circumscribing the heat source.

In one embodiment, the inner layer 47 of insulation may include a variety of non-glass filaments or fibers that are woven, knit, or both woven and knit (such as, for example, so-called 3-D woven/knit hybrid mats). When woven, an inner layer 47 may be formed as a woven mat or tube. A woven or knitted mat or tube can provide superior control of air flow with regard to evenness across the insulation layer, including as any thermal-related changes may occur to the layer). Those of skill in the art will appreciate that a woven, knit, or hybrid material may provide more regular and consistent air spaces/gaps between the filaments or fibers as compared to a non-woven material which is more likely to have irregularly closed and open spaces that may provide comparatively non-uniform and/or decreased air-flow.

Preferably, both ends of the heat generation segment 35 are open to expose the heat source 40 and insulation 42 to the adjacent segments. The heat source 40 and the surrounding insulation 42 can be configured so that the length of both materials is co-extensive (i.e., the ends of the insulation 42 are flush with the respective ends of the heat source 40, and particularly at the downstream end of the heat generation segment). Optionally, though not necessarily preferably, the insulation 42 may extend slightly beyond (e.g., from about 0.5 mm to about 2 mm beyond) either or both ends of the heat source 40. Moreover, smoke produced when the smokable lighting end segment 22 is burned during use of the smoking article 10 can readily pass through the heat generation segment 35 during draw by the smoker on the mouth end 18.

The heat generation segment 35 preferably is positioned adjacent to the downstream end of the smokable lighting end segment 22 such that those segments are axially aligned in an end-to-end relationship, preferably abutting one another, but with no barrier (other than open air-space) therebetween. The close proximity of the heat generation segment 35 and the smokable lighting end segment 22 provides for an appropriate heat exchange relationship (e.g., such that the action of burning smokable material within the smokable lighting end segment 22 acts to ignite the heat source of the heat generation segment 35). The outer cross-sectional shapes and dimensions of the smokable lighting end and heat generation segments 22, 35, when viewed transversely to the longitudinal axis of the smoking article, can be essentially identical to one another (e.g., both appear to have a cylindrical shape, each having essentially identical diameters).

The cross-sectional shape and dimensions of the heat generation segment 35, prior to burning, can vary. Preferably, the cross-sectional area of the heat source 40 makes up about 10 percent to about 35 percent, often about 15 percent to about 25 percent of the total cross-sectional area of that segment 35; while the cross-sectional area of the outer or circumscribing region (comprising the insulation 42 and relevant outer wrapping materials) makes up about 65 percent to about 90 percent, often about 75 percent to about 85 percent of the total cross-sectional area of that segment 35. For example, for a cylindrical smoking article having a circumference of about 24 mm to about 26 mm, a representative heat source 40 has a generally circular cross-sectional shape with an outer diameter of about 2.5 mm to about 5 mm, often about 3 mm to about 4.5 mm.

Located downstream from the heat generation segment 35 is a longitudinally extending, cylindrical aerosol-generating segment 51. The aerosol-generating segment 51 includes a substrate material 55 that, in turn, acts as a carrier for an aerosol-forming agent or material (not shown). For example, the aerosol-generating segment 51 can possess a reconstituted tobacco material that includes processing aids, flavoring agents and glycerin.

The foregoing components of the aerosol-generating segment 51 can be disposed within, and circumscribed by, a wrapping material 58. A wrapping material 58 can be adapted to facilitate the transfer of heat from the lighting end 14 of the smoking article 10 (e.g., from the heat generation segment 35) to components of the aerosol-generating segment 51. That is, the aerosol-generating segment 51 and the heat generation segment 35 can be configured in a heat exchange relationship with one another. The heat exchange relationship is such that sufficient heat from the heat source 40 is supplied to the aerosol-formation region to volatilize aerosol-forming material for aerosol formation. In some embodiments, the heat exchange relationship is achieved by positioning those segments in close proximity to one another. A heat exchange relationship also can be achieved by extending a heat conductive material from the vicinity of the heat source 40 into or around the region occupied by the aerosol-generating segment 51.

A representative wrapping material 58 for the substrate material 55 can possess heat conductive properties, and can have the form of a metal or metal foil (e.g., aluminum) tube, or a laminated material having an outer surface comprising paper and an inner surface comprising metal foil. For example, the metal foil can conduct heat from the heat generation segment 35 to the aerosol-generating segment 51, in order to provide for the volatilization of the aerosol forming components contained therein.

The substrate material 55 can be provided from a blend of flavorful and aromatic tobaccos in cut filler form. Those tobaccos, in turn, can be treated with aerosol-forming material and/or at least one flavoring agent. The substrate material can be provided from a processed tobacco (e.g., a reconstituted tobacco manufactured using cast sheet or papermaking types of processes) in cut filler form. That tobacco, in turn, can be treated with, or processed to incorporate, aerosol-forming material and/or at least one flavoring agent, as well as a burn retardant (e.g., diammonium phosphate or another salt) configured to help prevent ignition and/or scorching by the heat-generation segment. The inner metal surface of the wrapping material 58 of the aerosol-generating segment 51 can act as a carrier for aerosol-forming material and/or at least one flavoring agent. For example, aerosol-forming material and/or at least one flavoring agent can be incorporated within a film formed on the inner metallic surface of a laminate of paper and aluminum foil using a polymeric film forming agent, such as ammonium alginate, sodium alginate, guar gum, ethyl cellulose, starch, or the like. In addition, aerosol-forming material and/or at least one flavoring agent can be carried by a plurality of metal pieces that can be dispersed throughout tobacco filler within the aerosol-generating segment. For example, aerosol-forming material can be carried on the surface of about 10 to about 20 strips of heat conductive material (e.g., thin aluminum foil), each strip being about 1 mm to about 2 mm wide, and about 10 mm to about 20 mm long. Furthermore, components of the aerosol-generating segment can include aerosol-forming material and/or at least one flavoring agent carried by a gathered or shredded paper-type material, such as a paper incorporating particles of absorbent carbon, alumina, or the like.

In other embodiments, the substrate 55 may include a tobacco paper or non-tobacco gathered paper formed as a plug section. The plug section may be loaded with aerosol-forming materials, flavorants, tobacco extracts, or the like in a variety of forms (e.g., microencapsulated, liquid, powdered). A burn retardant (e.g., diammonium phosphate or another salt) may be applied to at least a distal/lighting-end portion of the substrate to help prevent ignition and/or scorching by the heat-generation segment. Using a paper substrate may lessen the likelihood of scorching and may also offer a different and desirable flavor as compared to using tobacco cast sheet material.

In still other embodiments, the substrate 55 may include non-combustible materials, which may further reduce the risk of any off-taste or other undesirable effects associated with scorching or burning that may occur in the substrate due to heat from the heat-generation segment. The non-combustible materials may include metal, inorganic, ceramic, or polymeric fibers in a woven or non-woven assembly, formed so as to be gas-permeable. The woven or non-woven assembly of the substrate 55 may be loaded with aerosol-forming materials, flavorants, tobacco extracts, or the like in a variety of forms (e.g., microencapsulated, liquid, powdered).

Figure 2:
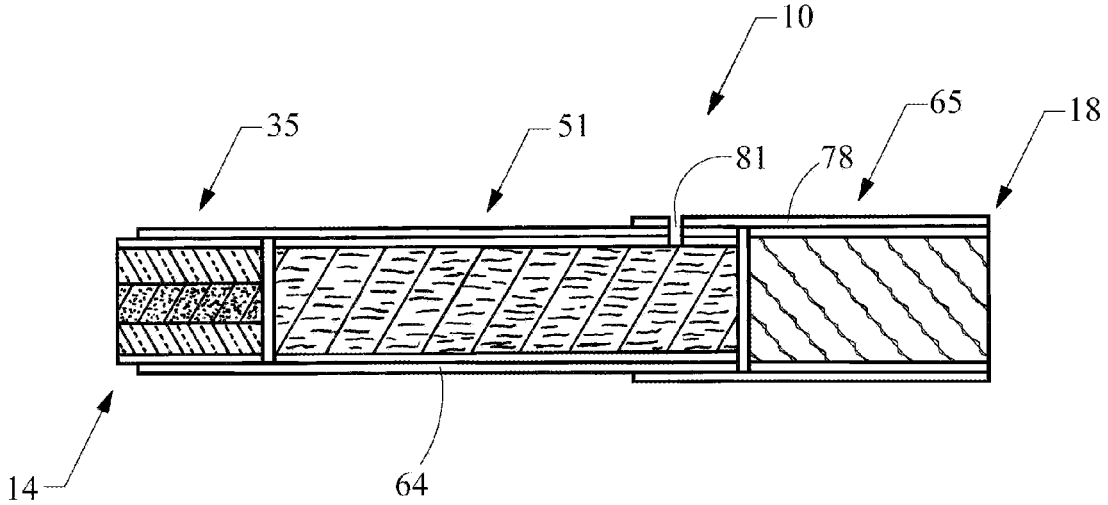

In these or other embodiments, the substrate 55 may include an open interior section 66 (as shown in FIG. 2). This open region may allow for aerosol condensation and improved transport/aerosolization of vaporizable materials being released by heat during use of the smoking article. The surface of the interior opening 66 may be coated or otherwise treated with flavorants, tobacco extracts, or other materials to provide desirable flavors and/or organoleptic properties to the aerosol traveling therethrough.

For preferred smoking articles, both ends of the aerosol-generating segment 51 are open to expose the substrate material 55 thereof. Components of the aerosol produced by burning the smokable lighting end segment 22 during use of the smoking article can readily pass through the aerosol-generating segment 51 during draw on the mouth end 18.

Together, the heat generating segment 35 and the aerosol-generating segment 51 form an aerosol-generation system 60. The aerosol-generating segment 51 is positioned adjacent to the downstream end of the heat generation segment 35 such that those segments 51, 35 are axially aligned in an end-to-end relationship. Those segments can abut one another, or be positioned in a slightly spaced apart relationship, which may include a buffer region 53. The outer cross-sectional shapes and dimensions of those segments, when viewed transversely to the longitudinal axis of the smoking article 10, can be essentially identical to one another. The physical arrangement of those components preferably is such that heat is transferred (e.g., by means that includes conductive and convective heat transfer) from the heat source 40 to the adjacent substrate material 55, throughout the time that the heat source is activated (e.g., burned) during use of the smoking article 10.

A buffer region 53 may reduce potential scorching or other thermal degradation of portions of the aerosol-generating segment 51. The buffer region 53 may mainly include empty air space, or (as may be understood with reference to FIG. 2) it may be partially or substantially completely filled with a non-combustible material such as, for example, metal, organic, inorganic, ceramic, or polymeric materials, or any combination thereof. These materials preferably would be included in a fibrous form that may be woven or non woven, but that most preferably is gas-permeable. In addition, or instead of fibrous material, the buffer region 53 may include a foamed metal, ceramic, or cermet (ceramic-metallic composite) monolith. Manufacturing procedures for creation of foamed materials suitable for use in the buffer region 53 are described in U.S. Pat. App. Pub. No. 2008/0233294 to Lobovsky, which is incorporated herein by reference. The buffer material 53 may incorporate flavor or odor materials within the fibrous or foamed monolith material. The buffer regions may be from about 1 mm to about 10 mm or more in thickness, but often will be about 2 mm to about 5 mm in thickness.

The components of the aerosol-generation system 60 and the smokable lighting end segment 22 preferably are attached to one another, and secured in place using an overwrap material 64. For example, the overwrap material 64 can include a paper wrapping material or a laminated paper-type material that circumscribes each of the heat generation segment 35, at least a portion of outer longitudinally extending surface of the aerosol-generating segment 51, and at least a portion of an the lighting end segment 22 that is adjacent to the heat generation segment. The inner surface of the overwrap material 64 may be secured to the outer surfaces of the components it circumscribes by a suitable adhesive. Preferably, the overwrap material 64 extends over a significant portion of the length of the smokable lighting end segment 22. A portion of the overwrap material 64 that extends beyond the smokable lighting end segment 22 can include slits or flutes, as desired, to assist in folding the overwrap over the extreme lighting end of the smoking article. The overwrap material 64, as well as other appropriate wrapping materials, can be treated in appropriate regions in the manner set forth in U.S. Pat. No. 6,874,508 to Shafer et al., which is incorporated herein by reference in its entirety. The overwrap material may also include a thermochroic or temperature sensitive ink (that may be microencapsulated and disposed within the overwrap material), which may appear, disappear, or change color based upon the heat associated with progress of one's use of a smoking article. One example of a thermochroic ink is marketed as "Thermasure" by Sun Chemical Co.

The smoking article 10 preferably includes a suitable mouthpiece such as, for example, a filter element 65, positioned at the mouth end 18 thereof. The filter element 65 preferably is positioned at one end of the cigarette rod adjacent to one end of the aerosol-generating segment 51, such that the filter element 65 and the aerosol-generating segment 51 are axially aligned in an end-to-end relationship, abutting one another but without any barrier therebetween. Preferably, the general cross-sectional shapes and dimensions of those segments 51, 65 are essentially identical to one another when viewed transversely to the longitudinal axis of the smoking article. The filter element 65 may include filter material 70 that is overwrapped along the longitudinally extending surface thereof with circumscribing plug wrap material 72. In one example, the filter material 70 includes plasticized cellulose acetate tow, while in some examples the filter material may further include activated charcoal in an amount from about 20 to about 80 mg disposed as a discrete charge or dispersed throughout the acetate tow in a "Dalmatian type" filter. Both ends of the filter element 65 preferably are open to permit the passage of aerosol therethrough. The aerosol-generating system 60 preferably is attached to filter element 65 using tipping material 78. The filter element 65 may also include a crushable flavor capsule 76 of the type described in U.S. Pat. No. 7,479,098 to Thomas et al. and U.S. Pat. App. Pub. Nos. 2006/0272663 to Dube et al.; and 2009/0194118 to Ademe et al., which are incorporated herein by reference in their entirety.

In certain embodiments, a filter may include carbon fibers. Suitable carbon fibers can be described as fibers obtained by the controlled pyrolysis of a precursor fiber. Since carbon is typically difficult to shape into fiber form, commercial carbon fibers are often made by extrusion of a precursor material into filaments, which is followed by carbonization, usually at high temperature. Common precursors for carbon fibers include rayon, acrylic fibers (such as polyacrylonitrile or PAN), and pitch (which can include isotropic pitch and anisotropic mesophase pitch, as well as meltblown pitch fibers). Other precursors, such as cellulose, may also be converted to carbon fibers. KYNOL™ novoloid fibers (available from American Kynol, Inc., Pleasantville, N.Y.), are high-performance phenolic fibers that are transformed into activated carbon by a one-step process combining both carbonization and activation. Forming carbon fibers from rayon or acrylics generally consists of stabilization, carbonization, and graphitization, each taking place at successively higher temperatures, to sufficiently remove non-carbon species, such as oxygen, nitrogen, and hydrogen. Preparation of fibers using pitch also typically includes stabilization and carbonization; however, pitch is typically spun as part of the carbon fiber forming process, whereas pre-formed fibers from rayon or acrylics can be used directly. Activation can sometimes add yet further production steps. Sources of carbon fibers include Toray Industries, Toho Tenax, Mitsubishi, Sumitomo Corporation, Hexcel Corp., Cytec Industries, Zoltek Companies, and SGL Group. Other filter materials may include those disclosed in U.S. Pat. No. 5,246,017 to Saintsing et al., which is incorporated herein by reference.

Carbon fibers are often classified in three separate ways. First, they can be classified based on modulus and strength. Examples include ultra high modulus (UHM) fibers (modulus >450 Gpa); high modulus (HM) fibers (modulus between 350 and 450 Gpa); intermediate modulus (IM) fibers (modulus between 200 and 350 Gpa); low modulus, high tensile (HT) fibers (modulus <100 Gpa and tensile strength >3.0 Gpa); and super high tensile (SHT) fibers (tensile strength >4.5 Gpa). Second, carbon fibers can be classified based on the precursor material used to prepare the fiber (e.g., PAN, rayon, pitch, mesophase pitch, isotropic pitch, or gas phase grown fibers). Third, carbon fibers can be classified based on the final heat treatment temperature. Examples include Type-I, high heat treatment (HTT) fibers (final heat treatment temperature above 2,000° C.), Type-II, intermediate heat treatment (IHT) fibers (final heat treatment temperature around 1,500° C.), and Type-III low heat treatment (LHT) fibers (final heat treatment not greater than 1,000° C.). Any of the above classifications of carbon fibers could be used in various embodiments of the present invention.

Examples of starting materials, methods of preparing carbon-containing fibers, and types of carbon-containing fibers are disclosed in U.S. Pat. No. 3,319,629 to Chamberlain; U.S. Pat. No. 3,413,982 to Sublett et al.; U.S. Pat. No. 3,904,577 to Buisson; U.S. Pat. No. 4,281,671 to Bynre et al.; U.S. Pat. No. 4,876,078 to Arakawa et al.; U.S. Pat. No. 4,947,874 to Brooks et al.; U.S. Pat. No. 5,230,960 to Iizuka; U.S. Pat. No. 5,268,158 to Paul, Jr.; U.S. Pat. No. 5,338,605 to Noland et al.; U.S. Pat. No. 5,446,005 to Endo; U.S. Pat. No. 5,482,773 to Bair; U.S. Pat. No. 5,536,486 to Nagata et al.; U.S. Pat. No. 5,622,190 to Arterbery et al.; and U.S. Pat. No. 7,223,376 to Panter et al.; and U.S. Pat. App. Pub. Nos. 2006/0201524 to Zhang et al. and 2006/0231113 to Newbery et al., all of which are incorporated herein by reference. Disclosure around PAN-based carbon fibers particularly (including manufacturers thereof) is provided in the report to congress entitled "Polyacrylonitrile (PAN) Carbon Fibers Industrial Capability Assessment: OUSD(AT&L) Industrial Policy" (October 2005), available on-line at http://www.acq.osd.mil/ip/docs/pan_carbon_fiber_report_to_congress_10-2005.pdf, which is incorporated herein by reference.

The smoking article 10 can include an air dilution means, such as a series of perforations 81, each of which extend through the filter element tipping material 78 and plug wrap material 72.

The overall dimensions of the smoking article 10, prior to burning, can vary. Typically, smoking articles 10 are cylindrically shaped rods having circumferences of about 20 mm to about 27 mm, have overall lengths of about 70 mm to about 130 mm—often about 83 mm to about 100 mm. Smokable lighting end segments 22 typically have lengths of about 3 mm to about 15 mm, but can be up to about 30 mm. The aerosol-generation system 60 has an overall length that can vary from about 20 mm to about 65 mm. The heat generation segment 35 of the aerosol-generation system 60 may have a length of about 5 mm to about 30 mm; and the aerosol-generating segment 51 of the aerosol-generation system 60 may have an overall length of about 10 mm to about 60 mm.

The amount of smokable material 26 employed to manufacture the smokable lighting end segment 22 can vary. Typically, the smokable lighting end segment 22, manufactured predominantly from tobacco cut filler, includes at least about 20 mg, generally at least about 50 mg, often at least about 75 mg, and frequently at least 100 mg, of tobacco material, on a dry weight basis. The packing density of the smokable material 26 within the smokable lighting end segment 22 preferably is less than the density of the fuel element (e.g., about 100 to about 400 mg/cm$^3$). Preferably, the smokable lighting end segment 22 essentially comprises smokable material 26, and does not include a carbonaceous fuel element component.

The combined amount of aerosol-forming agent and substrate material 55 employed in the aerosol-generating segment 51 can vary. The material preferably may be employed so as to fill the appropriate section of the aerosol-generating segment 51 (e.g., the region within the wrapping material 58 thereof) at a packing density of about 100 to about 400 mg/cm$^3$.

During use, the smoker lights the lighting end 14 of the smoking article 10 using a match or cigarette lighter, in a manner similar to the way that conventional smoking articles are lit. As such, the smokable material 26 of the smokable lighting end segment 22 begins to burn. The mouth end 18 of the smoking article 10 is placed in the lips of the smoker. Thermal decomposition products (e.g., components of tobacco smoke) generated by the burning smokable material 26 are drawn through the smoking article 10, through the filter element 65, and into the mouth of the smoker. That is, when smoked, the smoking article yields visible mainstream aerosol that resembles the mainstream tobacco smoke of traditional cigarettes that burn tobacco cut filler.

Burning of the smokable lighting end segment 22 heats the fuel element 40 of the heat generation segment 35 such that it preferably will be ignited or otherwise activated (e.g., begin to burn). The heat source 40 within the aerosol-generation system 60 will burn, and provide heat to volatilize aerosol-forming material within the aerosol-generating segment 51 as a result of the heat exchange relationship between those two segments. Preferably, the components of the aerosol-generating segment 51 do not experience thermal decomposition (e.g., charring or burning) to any significant degree. Volatilized components are entrained in the air that is drawn through the aerosol-generating region 51. The aerosol so formed will be drawn through the filter element 65, and into the mouth of the smoker.

During certain periods of use, aerosol formed within the aerosol-generating segment 51, along with the aerosol (i.e., smoke) formed as a result of the thermal degradation of the smokable material 26 within the smokable lighting end segment 22, will be drawn through the filter element 65 and into the mouth of the smoker, along with the aerosol (i.e., smoke) formed as a result of the thermal degradation of the smokable material 26 within the smokable lighting end segment 22. Thus, the mainstream aerosol produced by the smoking article 10 includes tobacco smoke produced by the thermal decomposition of the tobacco cut filler as well as by the volatilized aerosol-forming material. For early puffs (i.e., during and shortly after lighting), most of the mainstream aerosol results from thermal decomposition of the smokable lighting end segment 22. For later puffs (i.e., after the smokable lighting end segment 22 has been consumed and the heat source 40 of the aerosol-generation system 60 has been ignited), most of the mainstream aerosol that is provided will be produced by the aerosol-generation system 60. When the smokable material 26 has been consumed, and the heat source 40 extinguishes, the use of the smoking article is ceased (i.e., the smoking experience is finished).

Referring to FIG. 2, a representative smoking article 10 in the form of a cigarette is shown. The smoking article 10 includes a heat generation segment 35 located at the lighting end 14, a filter segment 65 located at the other end (mouth end 18), and an aerosol-generating segment 51 (which may incorporate tobacco) that is located in between those two segments near the lighting end. The heat generation segment 35 of FIG. 2 can incorporate a generally cylindrical carbonaceous heat source circumscribed by insulation similar to what is shown in FIG. 1. The composition and dimensions of the various segments of the smoking article 10 in FIG. 2 are generally similar in manner with respect to those set forth previously with reference to FIG. 1, but without a charge of smokable material at the distal/lighting end, such that the fuel element is ignited directly rather than by a smokable material that was ignited and burned.

A filter element 65 preferably is attached to the cigarette rod so formed using a tipping material 78, in the general manner set forth previously with reference to FIG. 1. The smoking article optionally can be air-diluted by providing appropriate perforations 81 in the vicinity of the mouth end region 18, as is known in the art. Filters may include Flavor may be provided or enhanced by capsule or microcapsule materials on or within the substrate material 55 of the aerosol-generating segment 51 (FIG. 1 should be considered to have microcapsules present therein for illustrative purposes), the wrapping materials, the filter element 65, or any other component capable of holding and releasing flavorants, preferably with minimal thermal degradation that would undesirably alter the flavor. Microcapsules may be incorporated into the tipping material 78 and/or other components and configured to release flavorant(s), for example, upon contact with moisture and/or warmth of a smoker's lips, heat from the heat generation segment 35, or by physical manipulation of the smoking article 10 (e.g., rolling squeezing). For examples of synthetic capsules and biologically-derived "capsules" (e.g., yeast organisms as a delivery means) and methods that may be used within the scope of the embodiments of the present invention, see Kondo, Microcapsule Processing and Technology, ISBN 0824768574 (1979); Iwamoto et al., AAPS Pharm. Sci. Tech. 2002 3(3): article 25; U.S. Pat. No. 3,550,598 to McGlumphy, U.S. Pat. No. 6,117,455 to Takada et al., U.S. Pat. No. 7,381,175 to Dawson et al., and U.S. Pat. No. 7,478,637 to Karles et al.; U.S. Pat. App. Pub. Nos. 2006/0144412 to Mishra et al.; 2006/0174901 to Karles, et al.; 2007/0012327 to Karles, et al.; and 2007/0095357 to Besso, et al., and 2008/0142028 to Fagg, each of which is incorporated by reference herein. Representative types of capsules and components thereof also are set forth in U.S. Pat. No. 3,339,558 to Waterbury; U.S. Pat. No. 3,390,686 to Irby, Jr. et al.; U.S. Pat. No. 3,685,521 to Dock; U.S. Pat. No. 3,916,914 to Brooks et al.; U.S. Pat. No. 4,889,144 to Tateno et al. and U.S. Pat. No. 6,631,722 to MacAdam et al.; U.S Pat. Pub. Nos. 2004/0261807 to Dube et al.; and PCT App. No. WO 03/009711 to Kim; which are incorporated herein by reference. See also, the types of capsules and components thereof set forth in U.S. Pat. No. 5,223,185 to Takei et al.; U.S. Pat. No. 5,387,093 to Takei; U.S. Pat. No. 5,882,680 to Suzuki et al.; U.S. Pat. No. 6,719,933 to Nakamura et al.; and U.S. Pat. No. 6,949,256 to Fonkwe et al.; and U.S. Pat. App. Pub. Nos. 2004/0224020 to Schoenhard; 2005/0196437 to Bednarz et al., 2005/0249676 to Scott et al., and 2009/0194118 to Ademe et al.; which are all incorporated herein by reference. Other flavor components associated with a filter may also be used; see, for example, U.S. Pat. No. 5,724,997 to Fagg, et al.

Cigarettes described with reference to FIG. 2 may be used in much the same manner as those cigarettes commercially marketed under the trade name "Eclipse" by R. J. Reynolds Tobacco Company. See also the "Steam Hot One" cigarette marketed by Japan Tobacco Inc.

Various components of the foregoing can be manufactured using conventional or appropriately modified types of cigarette and cigarette component manufacturing techniques and equipment. See, for example, the types of component configurations, component materials, assembly methodologies and assembly technologies set forth in U.S. Pat. No. 5,052,413 to Baker et al.; U.S. Pat. No. 5,088,507 to Baker et al.; U.S. Pat. No. 5,105,838 to White et al.; U.S. Pat. No. 5,469,871 to Barnes et al.; and U.S. Pat. No. 5,551,451 to Riggs et al.; and U.S. Pat. App. Pub. No. 2005/0066986 to Nestor et al., which are incorporated herein by reference in their entirety. Examples of equipment include that available under the brand names Mulfi or Merlin from Hauni Maschinenbau AG of Hamburg, Germany; LKF-01 Laboratory Multi Filter Maker from Heinrich Burghart GmbH; tipping devices available as Lab MAX, MAX, MAX S or MAX 80 banding devices from Hauni Maschinenbau AG. See also, for example, the types of devices and combination techniques set forth in U.S. Pat. No. 3,308,600 to Erdmann et al.; U.S. Pat. No. 4,280,187 to Reuland et al.; U.S. Pat. No. 4,281,670 to Heitmann et al.; U.S. Pat. No. 6,229,115 to Vos et al.; and U.S. Pat. No. 7,296,578 to Read, Jr., which are incorporated herein by reference in their entirety.

Smokable materials of the smokable lighting end segment most preferably incorporate tobacco of some form. Preferred smokable materials are composed predominantly of tobacco of some form, based on the dry weights of those materials. That is, the majority of the dry weight of those materials, and the majority of the weight of a mixture incorporating those materials (including a blend of materials, or materials having additives applied thereto or otherwise incorporated therein) are provided by tobacco of some form. Those materials also can be primarily made all of tobacco material, and not incorporate any non-tobacco fillers, substitutes or extenders. The smokable material can be treated with tobacco additives of the type that are traditionally used for the manufacture of cigarettes, such as casing and/or top dressing components. These tobacco components may be understood with reference to the examples and references set forth in U.S. Pat. App. Pub. No. 2007/0215167 to Crooks, et al., which is incorporated herein by reference in its entirety.

Fuel elements of the heat generation segment may vary. Suitable fuel elements, and representative components, designs and configurations thereof, and manners and methods for producing those fuel elements and the components thereof, are set forth in U.S. Pat. No. 4,714,082 to Banerjee et al.; U.S. Pat. No. 4,756,318 to Clearman et al.; U.S. Pat. No. 4,881,556 to Clearman et al.; U.S. Pat. No. 4,989,619 to Clearman et al.; U.S. Pat. No. 5,020,548 to Farrier et al.; U.S. Pat. No. 5,027,837 to Clearman et al.; U.S. Pat. No. 5,067,499 to Banerjee et al.; U.S. Pat. No. 5,076,297 to Farrier et al.; U.S. Pat. No. 5,099,861 to Clearman et al.; U.S. Pat. No. 5,105,831 to Banerjee et al.; U.S. Pat. No. 5,129,409 to White et al.; U.S. Pat. No. 5,148,821 to Best et al.; U.S. Pat. No. 5,156,170 to Clearman et al.; U.S. Pat. No. 5,178,167 to Riggs et al.; U.S. Pat. No. 5,211,684 to Shannon et al.; U.S. Pat. No. 5,247,947 to Clearman et al.; U.S. Pat. No. 5,345,955 to Clearman et al.; U.S. Pat. No. 5,469,871 to Barnes et al.; U.S. Pat. No. 5,551,451 to Riggs; U.S. Pat. No. 5,560,376 to Meiring et al.; U.S. Pat. No. 5,706,834 to Meiring et al.; and U.S. Pat. No. 5,727,571 to Meiring et al.; and U.S. Pat. App. Pub. No. 2005/0274390 to Banerjee et al.; which are incorporated herein by reference.

Fuel elements often comprise carbonaceous material and may include ingredients such as graphite or alumina, as well as high carbon content carbonaceous material. Carbonaceous fuel elements include the type that have been incorporated within those cigarettes commercially marketed under the trade names "Premier" and "Eclipse" by R. J. Reynolds Tobacco Company. See also the "Steam Hot One" cigarette marketed by Japan Tobacco Inc. Some other embodiments of fuel elements are set forth in U.S. Pat. No. 5,178,167 to Riggs et al. and U.S. Pat. No. 5,551,451 to Riggs et al., both which are incorporated herein by reference in their entirety, but certain embodiments may lack the sodium, graphite, and/or calcium carbonate set forth therein. Some fuel element embodiments may include a foamed carbon monolith formed in a foam process of the type disclosed in U.S. Pat. App. Pub. No. 2008/0233294 to Lobovsky, which is incorporated herein by reference. One example is a foamed carbon monolith available from Sulzer AG using the Optifoam™ system (which may also be used in the manufacture of other foamed monoliths and foamed materials wherever such materials are described herein, all within the scope of the present invention). This embodiment may provide advantages with regard to reduced time taken to ignite the heat source, as a foamed carbon monolith includes small open spaces not occupied with the organics and other potential sources of undesirable outgassing or pyrolysis products present in previous foamed compositions. Rather, a preferred foaming process uses carbon dioxide or nitrogen gas as the foaming agent (instead of standard blowing or foaming agents), leaving no appreciable residue in the foamed monolith formed. Such monoliths may not only be easier to light, but they may sustain more even combustion and heat generation. In another embodiment, the fuel element 40 may be co-extruded with a layer of insulation 42, thereby reducing manufacturing time and expense.

The fuel element can be circumscribed or otherwise jacketed by insulation, or other suitable material. The insulation can be configured and employed so as to support, maintain and retain the fuel element in place within the smoking article. The insulation can additionally be adapted such that drawn air and aerosol can pass readily therethrough. Examples of insulation materials, components of insulation assemblies, configurations of representative insulation assemblies within heat generation segments, wrapping materials for insulation assemblies, and manners and methods for producing those components and assemblies, are set forth in U.S. Pat. No. 4,807,809 to Pryor et al.; U.S. Pat. No. 4,893,637 to Hancock et al.; U.S. Pat. No. 4,938,238 to Barnes et al.; U.S. Pat. No. 5,027,836 to Shannon et al.; U.S. Pat. No. 5,065,776 to Lawson et al.; U.S. Pat. No. 5,105,838 to White et al.; U.S. Pat. No. 5,119,837 to Banerjee et al.; U.S. Pat. No. 5,247,947 to Clearman et al.; U.S. Pat. No. 5,303,720 to Banerjee et al.; U.S. Pat. No. 5,345,955 to Clearman et al.; U.S. Pat. No. 5,396,911 to Casey, III et al.; U.S. Pat. No. 5,546,965 to White; U.S. Pat. No. 5,727,571 to Meiring et al.; U.S. Pat. No. 5,902,431 to Wilkinson et al.; and U.S. Pat. No. 5,944,025 to Cook et al.; which are incorporated herein by reference. See, also, Chemical and Biological Studies on New Cigarette Prototypes that Heat Instead of Burn Tobacco, R. J. Reynolds Tobacco Company Monograph (1988). Insulation assemblies have been incorporated within the types of cigarettes commercially marketed under the trade names "Premier" and "Eclipse" by R. J. Reynolds Tobacco Company. See also the "Steam Hot One" cigarette marketed by Japan Tobacco Inc.

Assemblies of insulation 42 may be manufactured using at least one layer of non-woven glass filament mat. For example, the manufacturing may include one or more of the following steps: a web of at least one layer of non-woven glass filament mat can be wrapped around a continuously extruded fuel element; the face of the mat can be moistened with water (e.g., by spraying) in order to facilitate binding of the fuel element to the mat; the resulting assembly can be circumscribed with a continuous paper web (e.g., using two continuous center line strips adhesive and a seam line adhesive, each of which optionally can contain flavoring agents or burn modifiers); and the resulting continuous rod can be cut into segments of the desired length. If desired, flavoring agents, burn modifiers, and the like, can be incorporated within the water that is applied to the glass filament mat. For example, the types of technologies set forth in U.S. Pat. No. 5,065,776 to Lawson et al.; U.S. Pat. No. 5,727,571 to Meiring et al.; and U.S. Pat. No. 5,902,431 to Wilkinson et al., which are incorporated herein by reference in their entirety, optionally can be employed to provide suitable fuel element assemblies.

Insulation assemblies can incorporate materials such as calcium sulfate fibers, thermal resistant ceramic filaments, high-temperature resistant carbon filaments (e.g., graphite-type materials), and the like, which can be incorporated into non-woven mats. Insulation assemblies for use in smoking articles of the present invention also can incorporate tobacco; such as particles or pieces of tobacco dispersed within a glass filament mat, or configured as at least one layer of reconstituted tobacco sheet with at least one layer of glass filament mat.

A representative insulation layer may include a variety of non-glass filaments or fibers that are woven, knit, or both woven and knit (such as, for example, so-called 3-D woven/knit hybrid mats). This woven layer may be formed as a woven mat or tube. Woven fabrics are classified as to weave or structure according to the manner in which warp and weft cross each other. The three fundamental weaves, of which others are variations, are plain, twill, and satin weaves, each of which may be used alone, in combination with each other, or in combination with knit configurations as is known in the textile art. See, for example, U.S. Pat. Nos. 5,791,384 and 5,720,320, both to Evans, describing exemplary 3-D hybrids, both of which are incorporated by reference herein.

The non-glass materials may include inherently flame-retardant materials oxygen-depleting polymers, including carbon fibers and carbonized fibers. For example, regenerated cellulose in the form of rayon may be used. As another example, viscose (commercially available as Visil®), which is a regenerated cellulose product incorporating silica, may be used. Preferred carbon fibers include at least 95% carbon or more. Similarly, natural cellulose fibers such as cotton may be used, and preferably are infused or otherwise treated with silica, carbon, or metallic particles to enhance flame-retardant properties and minimize off-gassing, particularly of any undesirable off-gassing components that would have a negative impact on flavor (and especially minimizing the likelihood of any toxic off-gassing products). As is known in the art, cotton may be treated with, for example, boric acid or various organophosphate compounds to provide desirable flame-retardant properties by dipping, spraying or other techniques known in the art. These fibers may also be treated (coated, infused, or both by, e.g., dipping, spraying, or vapor-deposition) with organic or metallic nanoparticles to confer the desired property of flame-retardency without undesirable off-gassing or melting-type behavior.

These and other non-glass components in a woven insulation mat or inner layer 47 may be preferable to glass fibers, because glass fibers may partially burn or melt, forming an intumescent layer that will block oxygen from the heat source 40 and thereby inhibit the desired combustion/heat generation reaction. Other examples of fibers that may be used in a woven mat or tube forming the layer 47 include metallic fibers, metalized fibers/fabrics, such as metalized cellulose or metalized synthetic polymers that have been treated with aluminum or other metals or metallic compounds, or any combination thereof. The woven and/or knit configuration provides for a more uniform mat composition that will promote superior airflow and combustion.

The fibers used in an insulation may be inherently flame retardant as they have been manufactured (e.g., spun), either because of inherent properties of the fiber chemical composition or having been made flame retardant by including an additive during or after a manufacturing/spinning process. The fiber chemical composition may include organic polymers, glasses, metals, or ceramics. These fibers most preferably will not emit undesirable (e.g., unpleasant tasting/smelling, toxic) compounds during the combustion process and negatively impact the smoke chemistry in a significant way. Organic polymers such as viscose rayon may be made flame retardant by suitable additives such as silica during the fiber making process. Examples of commercially available rayon products include, for example, Visil® from Kuitu of Finland and Corona® from Daiwabo Rayon Company of Japan. Other additive-free flame retardant organic fibers include partial or complete carbonized rayon-based carbon fibers from Sohim of Belarus and fully carbonized polyacrylonitrile-based carbon fibers available from a variety of manufacturers. Glass fibers and non-glass fibers may include a silicon oxide content varying from about 20% to about 99%. Metal fibers may include one or more of a variety of metals such as stainless steel, aluminum, and/or alloys of various metals. Suitable ceramic fibers may include alumina, beryllia, magnesia, thoria, zirconia, silicon carbide, and/or quartz. Inherently flame retardant fibers may also be produced by core-spinning processes in which an ordinary fiber such as cotton is wrapped around or otherwise wound or woven with a flame-retardant fiber such as glass, metal (e.g., metallic and/or metalized material), or ceramic.

Flame retardant fibers such as those described above may be used to produce an insulation fabric in any number of ways for use within the scope of the present invention by using a single fiber type or a mixture of fiber types. Such fabrics can be non-woven, woven, knit, or combination of these as in woven-knit fabrics such as in 3-D fabrics. Non-woven fabrics may be made by spun lace, needle punch, wet-laid, air laid, air blown, and other known manufacturing techniques. The woven fabrics may include any of many constructions such as, for example, plain weave, basket weave, twill weave, satin weave, etc. A more detailed description of various weave types can be found in "Handbook of Weaving" by Sabit Adanur, CRC Press 2001 ISBN 158716137, which is incorporated herein by reference. The knit fabrics may include warp-knit or weft-knit type fabrics. A combination of knitting and weaving may be employed to construct 3-D insulation fabrics.

In addition to producing insulation fabrics by the above-described processes using inherently flame-retardant fibers, fabrics with insulation properties may be produced by chemical finishing of normal fabrics such as cotton and rayon. During such a finishing/flame-retardency-providing process, the fabric may be treated with a chemical agent that imparts flame retardancy by coating the fabric with techniques such as dip-coating, spray-coating, roll-coating, or another coating process. The chemical agents used should not negatively impact the smoke chemistry by producing for example nitrogen oxides upon combustion. Preferable chemical agents are; organo-phosphorus compounds, boric acid, borax, hydrated alumina, graphite, potassium tripolyphosphate, dipentaerythritol, pentaerythritol, and polyols but others such as nitrogenous phosphonic acid salts, mono and di-ammonium phosphate, ammonium polyphosphate, ammonium bromide, ammonium chloride, ammonium borate, ethanolammonium borate, ammonium sulphamate, halogenated organic compounds, thio-urea, antimony oxides, can be used but are not preferred agents. These flame-retardant materials may also be used in combination with each other.

An insulation fabric made by any one of the above processes preferably will have sufficient oxygen diffusion capability to sustain a smoking article such as a cigarette lit during a desired usage time. Accordingly the insulation fabric preferably will be porous by virtue of its construction. In knit, woven, or combined woven and knit constructions, the required porosity may be controlled by configuring the assembly machinery to leave sufficient (desirably sized) gaps between fibers to allow for oxygen diffusion into the heat source. For non-woven fabrics, which may not be porous enough to promote evenly sustained combustion, additional porosity may be achieved by perforations into the insulation by methods known in the art including, for example, hot or cold pin perforation, flame perforation, embossing, laser cutting, drilling, blade cutting, chemical perforation, punching, and other methods. Each of the buffer and the insulation may include non-glass material that is woven, knit, or a combination thereof, a foamed metal material, a foamed ceramic material, a foamed ceramic metal composite, and any combination thereof, and the material in the insulation may be the same as or different than that in the buffer.

These various exemplary fibers may be used alone or in any combination with each other. For example, two or more kinds of fibers may be woven and/or knit together to form a mat or tube (e.g., for layer 47). As another example, two or more of the fibers may be combined in a yarn or other multifilament thread configuration that is then woven with like or unlike fibers to form the insulation layer. This configuration may provide better control of air flow to the heat source. For example, the structural integrity of the woven fibers may be less likely to compact than non-woven fibers, and is better able to maintain a consistent porosity and permeability throughout. These features may promote more efficient combustion at a desired temperature for minimizing undesired off-gassing products. The woven, knit, or hybrid construction with these non-glass fibers may also present cost savings for materials and manufacture.

Alternatively, paper-type materials (e.g., paper-type materials treated with appropriate salts, such as potassium chloride, in amounts sufficient to provide certain degrees of heat resistant character thereto) can be gathered, or crimped and gathered, around the fuel element in order to adequately hold the fuel element securely in place within the smoking article. Moreover, tobacco cut filler (e.g., a shredded lamina, pieces of tobacco stems, shredded reconstituted tobacco paper-type sheet, shredded reconstituted tobacco cast sheet, or blends of the foregoing), which can be treated with appropriate salts, such as is set forth in U.S. Patent Application Pub. No. 2005/0066986 to Nestor et al., which is incorporated herein by reference in its entirety, can surround the peripheral region of the fuel element, in order to adequately hold the fuel element securely in place within the cigarette. Representative types of tobacco materials can be manufactured from mixtures of tobacco types; or from one predominant type of tobacco (e.g., a cast sheet-type or paper-type reconstituted tobacco composed primarily of burley tobacco, or a cast sheet-type or paper-type reconstituted tobacco composed primarily of Oriental tobacco). Alternatively, embodiments of the insulation segment may include no tobacco ingredients; that is, in some embodiments, there may be no tobacco in the insulation segments. Flavoring agents (e.g., volatile flavoring agents) can be incorporated within the insulation assembly, and as such, (i) flavor can be entrained within drawn aerosol that is produced by burning of the smokable material as that aerosol passes through the insulation assembly, and (ii) the flavor of aerosol produced by burning the fuel element of the heat generation segment can be enhanced.

Another embodiment of an insulation material 42 may include a porous ceramic monolith including metal, ceramic, or cermet formed in a foam process of the type disclosed in U.S. Pat. App. Pub. No. 2008/0233294 to Lobovsky, which is incorporated herein by reference. A fuel element 40 may be inserted in the monolith, which will serve as an effective heat insulator.

The aerosol-forming material can vary, and mixtures of various aerosol-forming materials can be used, as can various combinations and varieties of flavoring agents (including various materials that alter the sensory and/or organoleptic character or nature of mainstream aerosol of a smoking article), wrapping materials, mouth-end pieces, filter elements, plug wrap, and tipping material. Representative types of these components are set forth in U.S. Pat. App. Pub. No. 2007/0215167 to Crooks, et al., which is incorporated herein by reference in its entirety.

The substrate material can incorporate tobacco of some form, normally is composed predominantly of tobacco, and can be provided by virtually all tobacco material. The form of the substrate material can vary. In some embodiments, the substrate material is employed in an essentially traditional filler form (e.g., as cut filler). The substrate material can be otherwise formed into desired configurations. The substrate material can be used in the form of a gathered web or sheet, using the types of techniques generally set forth in U.S. Pat. No. 4,807,809 to Pryor et al, which is incorporated herein by reference in its entirety. The substrate material can be used in the form of a web or sheet that is shredded into a plurality of longitudinally extending strands, using the types of techniques generally set forth in U.S. Pat. No. 5,025,814 to Raker, which is incorporated herein by reference in its entirety. The substrate material can have the form of a loosely rolled sheet, such that a spiral type of air passageway extends longitudinally through the aerosol-generating segment. Representative types of tobacco containing substrate materials can be manufactured from mixtures of tobacco types; or from one predominant type of tobacco (e.g., a cast sheet-type or paper-type reconstituted tobacco composed primarily of burley tobacco, or a cast sheet-type or paper-type reconstituted tobacco composed primarily of Oriental tobacco).

The substrate material also can be treated with tobacco additives of the type that are traditionally used for the manufacture of cigarettes, such as casing and/or top dressing components. See, for example, the types of components set forth in U.S. Pat. Publication 2004/0173229 to Crooks et al, which is incorporated herein by reference in its entirety.

The manner by which the aerosol-forming material is contacted with the substrate material (e.g., the tobacco material) can vary. The aerosol-forming material can be applied to a formed tobacco material, or can be incorporated into processed tobacco materials during manufacture of those materials. The aerosol-forming material can be dissolved or dispersed in an aqueous liquid, or other suitable solvent or liquid carrier, and sprayed onto that substrate material. See, for example, U.S. Patent Application Pub. No. 2005/0066986 to Nestor et al, which is incorporated herein by reference in its entirety. The amount of aerosol-forming material employed relative to the dry weight of substrate material can vary. Materials including exceedingly high levels of aerosol-forming material can be difficult to process into cigarette rods using conventional types of automated cigarette manufacturing equipment.

Cast sheet types of materials may incorporate relatively high levels of aerosol-forming material. Reconstituted tobaccos manufactured using paper-making types of processes may incorporate moderate levels of aerosol-forming material. Tobacco strip and tobacco cut filler can incorporate lower amounts of aerosol-forming material. Various paper and non-paper substrates including gathered, laminated, laminated metal/metallic, strips, beads such as alumina beads, open cell foam, foamed monolith, air permeable matrices, and other materials can be used within the scope of the invention. See, for example, U.S. Pat. Nos. 5,183,062; 5,203,355; and 5,588,446; each to Clearman, and each of which is incorporated herein by reference.

Other types of materials incorporating relatively high levels of aerosol-forming material can be incorporated in the aerosol-generating segment. Formed, encapsulated or microencapsulated materials can be employed. Such types of materials, in some embodiments, primarily include aerosol-forming material, and those materials can incorporate some amount and form of tobacco. An example of such a type of material is a film produced by casting and drying an aqueous solution of about 65 to about 70 weight parts glycerin, and about 25 to about 30 weight parts binder (e.g., citrus pectin, ammonium alginate, sodium alginate or guar gum), and about 5 weight parts flavoring agent (e.g., vanillin, coffee, tea, cocoa and/or fruit flavor concentrates); and then surface-coating that film with about 2 to about 10 weight parts of a finely divided powder that is provided by milling tobacco lamina. Other aerosol-forming materials besides (or in addition to) glycerin may include propylene glycol, polyethylene glycol, triacetin, tri-ethyl citrate, alcohol, and any mixture thereof. These aerosol-forming materials may be microencapsulated in the manner described with reference herein to flavorants, which may help to provide a desirably consistent release of the material during use of a smoking article.

The amount of aerosol-forming material that is used within the aerosol-generating segment preferably is such that the cigarette exhibits acceptable sensory and organoleptic properties, and desirable performance characteristics. For example, sufficient aerosol-forming material, such as glycerin, can be employed in order to provide for the generation of a visible mainstream aerosol which in many regards resembles the appearance of tobacco smoke. It is desirable for those components not to introduce significant degrees of unacceptable off-taste, filmy mouth-feel, or an overall sensory experience that is significantly different from that of a traditional type of cigarette that generates mainstream smoke by burning tobacco cut filler. The selection of the components, the amounts of those components used, and the types of tobacco material used, can be altered in order to control the overall chemical composition of the mainstream aerosol produced by the cigarette.

Exemplary other cigarette components (e.g., adhesives), component designs, and design configurations and formats for representative of cigarettes have been incorporated within the types of cigarettes commercially marketed under the trade names "Premier" and "Eclipse" by R. J. Reynolds Tobacco Company, and also are set forth in U.S. Pat. App. Pub. No. 2007/0023056 to Cantrell et al.; which is incorporated herein by reference in its entirety. See also the "Steam Hot One" cigarette marketed by Japan Tobacco Inc.

Cigarettes of the present invention may be air-diluted or ventilated such that the amount of air dilution for an air diluted cigarette may be about 10 percent to about 80 percent. As used herein, the term "air dilution" is the ratio (expressed as a percentage) of the volume of air drawn through the air dilution means to the total volume of air and aerosol drawn through the cigarette and exiting the mouth end portion of the cigarette. Higher air dilution levels can act to reduce the transfer efficiency of aerosol-forming material into mainstream aerosol.

In some embodiments, cigarettes will exhibit desirable resistance to draw. For example, an exemplary cigarette exhibits a pressure drop of between about 50 and about 200 mm water pressure drop at 17.5 cc/sec. air flow. Preferred cigarettes exhibit pressure drop values of between about 60 mm and about 180 mm, and, in some embodiments, between about 70 mm to about 150 mm, water pressure drop at 17.5 cc/sec. air flow. Pressure drop values of cigarettes are measured using a Filtrona Cigarette Test Station (CTS Series) available from Filtrona Instruments and Automation Ltd.

Preferred embodiments of cigarettes of the present invention, when smoked, yield an acceptable number of puffs. Such cigarettes normally provide more than about 6 puffs, and generally more than about 8 puffs, per cigarette, when machine-smoked under standardized smoking conditions. Such cigarettes normally provide less than about 15 puffs, and generally less than about 12 puffs, per cigarette, when smoked under standardized smoking conditions. Standardized smoking conditions consist of 35 ml puffs of 2 second duration separated by 58 seconds of smolder.

Aerosols that are produced by cigarettes of the present invention are those that comprise air-containing components such as vapors, gases, suspended particulates, and the like. Aerosol components can be generated from burning tobacco of some form (and optionally other components that are burned to generate heat); by thermally decomposing tobacco caused by heating tobacco and charring tobacco (or otherwise causing tobacco to undergo some form of smolder); and by vaporizing aerosol-forming agent. As such, the aerosol can contain volatilized components, combustion products (e.g., carbon dioxide and water), incomplete combustion products, and products of pyrolysis.

Aerosol components may also be generated by the action of heat from burning tobacco of some form (and optionally other components that are burned to generate heat), upon substances that are located in a heat exchange relationship with tobacco material that is burned and other components that are burned. Aerosol components may also be generated by the aerosol-generation system as a result of the action of the heat generation segment upon an aerosol-generating segment. In some embodiments, components of the aerosol-generating segment have an overall composition, and are positioned within the smoking article, such that those components will have a tendency not to undergo a significant degree of thermal decomposition (e.g., as a result of combustion, smoldering or pyrolysis) during conditions of normal use.

Smoking articles of the present invention may be packaged for distribution, sale and use in any of the manners known in the art, and particularly those described in U.S. Pat. App. Pub. No. 2007/0215167 to Crooks, et al., which is incorporated herein by reference in its entirety.

Drawings in the figures illustrating various embodiments are not necessarily to scale. Some drawings may have certain details magnified for emphasis, and any different numbers or proportions of parts should not be read as limiting, unless so-designated by one or more claims. Those of skill in the art will appreciate that embodiments not expressly illustrated herein may be practiced within the scope of the present invention, including that features described herein for different embodiments may be combined with each other and/or with currently-known or future-developed technologies while remaining within the scope of the claims presented here. It is therefore intended that the foregoing detailed description be regarded as illustrative rather than limiting. And, it should be understood that the following claims, including all equivalents, are intended to define the spirit and scope of this invention.

What is claimed is:

1. A cigarette comprising:

a lighting end and a mouth end;

a smokable segment disposed at the lighting end, said smokable segment having a length and comprising a smokable material circumscribed by wrapping material;

a mouth end piece segment disposed at the mouth end;

an aerosol-generation system disposed between the smokable segment and the mouth end piece segment, the aerosol-generation system including (i) a heat generation segment adjacent to the smokable segment, said heat generation segment having a length and including a heat source configured to be activated by combustion of the smokable material and an insulation layer of flame-retardant material that circumscribes the heat source and that comprises a material selected from a group consisting of:

a foamed metal material;

a foamed ceramic material; and a foamed ceramic metal composite, and (ii) an aerosol-generating segment incorporating aerosol-forming material, said aerosol-generating segment having a length and being disposed between, but physically separate from, each of the heat generation segment and the mouth end;

a piece of outer wrapping material oriented to provide an overwrap (i) around the aerosol-generating segment for at least a portion of its length, (ii) around the heat generation segment for the length of that segment, and (iii) around the smokable segment for at least a portion of its length; those segments being connected together by the overwrap to provide a cigarette rod;

the mouth end piece segment being connected to the cigarette rod using tipping material, and further comprising a buffer between the heat generation segment and the aerosol-generating segment, wherein the buffer comprises a structure selected from a group consisting of:

a foamed metal material;

a foamed ceramic material;

a foamed ceramic metal composite; and any combination thereof.

2. The cigarette of claim 1, wherein the insulation further comprises a non-glass material selected from viscose rayon, stainless steel fibers, aluminum fibers, ceramic fibers, cotton, carbon fibers, metal oxide fibers, calcium sulfate, or combinations thereof.

3. The cigarette of claim 2, wherein the non-glass material further comprises viscose rayon that is woven, knit, or a combination thereof.

4. The cigarette of claim 1, wherein the heat generation segment and the aerosol-generating segment are in a heat exchange relationship with one another and the insulation provides an insulative layer about at least a portion of the heat source.

5. The cigarette of claim 1, wherein the insulation layer further comprises a woven layer of a non-glass material.

6. The cigarette of claim 5, wherein the insulation woven layer comprises viscose rayon.

7. The cigarette of claim 1, wherein the insulation layer comprises carbon fibers containing at least 95% carbon.

8. The cigarette of claim 1, wherein the insulation layer comprises rayon fibers treated with silica.

9. The cigarette of claim 1, wherein the insulation layer comprises cellulose fibers.

10. The cigarette of claim 1, wherein the insulation layer comprises a woven-knit hybrid material.

11. The cigarette of claim 1, wherein the insulation layer comprises a selected one of metalized fibers, metallic fibers, or a combination thereof.

12. The cigarette of claim 1, wherein the heat source comprises a foamed structure comprising carbon.

13. A cigarette comprising:

a lighting end and a mouth end;

a mouth end piece segment disposed at the mouth end;

an aerosol-generation system disposed near the lighting end, the aerosol-generation system including (i) a heat generation segment extending to the lighting end, said heat generation segment having a length and including a heat source circumscribed by an insulation layer of flame-retardant material that comprises a material selected from a group consisting of:

a foamed metal material;

a foamed ceramic material;

a foamed ceramic metal composite, and any combination thereof; and (ii) an aerosol-generating segment incorporating aerosol-forming material, said aerosol-generating segment having a length and being disposed between, but physically separate from, each of the heat generation segment and the mouth end; and a single piece of outer wrapping material oriented to provide an overwrap (i) around the mouth end piece segment for the length of that segment, (ii) around the aerosol-generating segment for the length of that segment, and (iii) around the heat generation segment for at least a portion of its length; and further comprising a buffer between the heat generation segment and the aerosol-generating segment, wherein the buffer comprises a structure selected from a group consisting of:

a foamed metal material;

a foamed ceramic material;

a foamed ceramic metal composite: and any combination thereof.

14. The cigarette of claim 13, wherein the length of the heat generation segment is less than about 30 mm, and the heat source comprises a carbonaceous fuel element.

15. The cigarette of claim 13, wherein the aerosol-generating segment comprises glycerin, propylene glycol or combinations thereof.

16. The cigarette of claim 13, wherein the heat generation segment and the aerosol-generating segment are in a heat exchange relationship with one another.

17. The cigarette of claim 13, wherein the insulation layer further comprises carbon fibers containing at least 95% carbon.

18. The cigarette of claim 13, wherein the insulation layer further comprises rayon fibers treated with silica.

19. The cigarette of claim 13, wherein the insulation layer further comprises cellulose fibers.

20. The cigarette of claim 13, wherein the insulation layer further comprises a woven-knit hybrid material.

21. The cigarette of claim 13, wherein the insulation layer further comprises a selected one of metalized fibers, metallic fibers, or a combination thereof.

22. The cigarette of claim 13, wherein the heat source comprises a foamed structure comprising carbon.

23. The cigarette of claim 13, wherein the aerosol-generating segment includes tobacco.

24. The cigarette of claim 13, wherein the insulation layer further comprises rayon fibers.

25. The cigarette of claim 13, wherein the insulation layer further comprises a woven layer of a non-glass material.

* * * * *